US009162515B2

(12) United States Patent
Maruyama et al.

(10) Patent No.: US 9,162,515 B2
(45) Date of Patent: Oct. 20, 2015

(54) WRITING IMPLEMENT REFILL AND WRITING IMPLEMENT

(71) Applicant: MITSUBISHI PENCIL COMPANY, LIMITED, Tokyo (JP)

(72) Inventors: Seiichi Maruyama, Yokohama (JP); Takeo Fukumoto, Yokohama (JP); Kazuhiko Furukawa, Yokohama (JP)

(73) Assignee: MITSUBISHI PENCIL CO., LTD., Tokyo (JP)

( * ) Notice: Subject to any disclaimer, the term of this patent is extended or adjusted under 35 U.S.C. 154(b) by 0 days.

(21) Appl. No.: 14/051,018

(22) Filed: Dec. 18, 2013

(65) Prior Publication Data

US 2014/0140752 A1 May 22, 2014

(30) Foreign Application Priority Data

Oct. 10, 2012 (JP) ..... 2012-225319

(51) Int. Cl.

| | |
|---|---|
| ***B43K 5/04*** | (2006.01) |
| ***B43K 7/02*** | (2006.01) |
| ***B43K 7/10*** | (2006.01) |
| ***B43K 8/03*** | (2006.01) |
| ***B43K 8/04*** | (2006.01) |
| ***B43K 5/18*** | (2006.01) |

(52) U.S. Cl.

CPC ... *B43K 7/02* (2013.01); *B43K 5/04* (2013.01); *B43K 5/18* (2013.01); *B43K 7/10* (2013.01); *B43K 8/03* (2013.01); *B43K 8/04* (2013.01)

(58) Field of Classification Search

CPC combination set(s) only.
See application file for complete search history.

(56) References Cited

U.S. PATENT DOCUMENTS 2,119,645 A * 6/1938 Pearson ..... 401/251
2,956,548 A * 10/1960 Perraud ..... 401/160

FOREIGN PATENT DOCUMENTS

JP 29-013711 Y 10/1954
JP 35-025220 Y 9/1960
JP 2000-177290 A 6/2000

* cited by examiner

*Primary Examiner* — David Walczak
(74) *Attorney, Agent, or Firm* — Westerman, Hattori, Daniels & Adrian, LLP

(57) ABSTRACT

A writing implement that prevents flow of air into an ink tank and prevents writing failure while allowing for productivity. The writing implement includes a writing implement refill having: an ink tank composed of films storing ink; a joint connected to a tip of the ink tank; and a writing tip connected to a tip of the joint. An inner circumferential surface of the tip of the ink tank covers an outer circumferential surface of a rear end of the joint. A covering member of a ring shape covers from outside an area where the tip of the ink tank covers the outer circumferential surface of the rear end of the joint.

6 Claims, 7 Drawing Sheets

WRITING IMPLEMENT REFILL AND WRITING IMPLEMENT

TECHNICAL FIELD

The present invention relates to a refill for a writing implement such as a ballpoint pen and a writing implement provided with the refill.

BACKGROUND ART

In the case of a publicly known conventional water-based ballpoint pen including an ink tank filled with low-viscosity ink directly poured therein, air needs to be taken into the ink tank for discharge of the ink during writing. If temperature increases or atmospheric pressure drops rapidly during writing, or if pressure inside the tank increases as a result of temperature increase or drop of atmospheric pressure while a cap is attached and then the cap is removed, the ink may jet out of the tank to soil a sheet of paper being written on or clothes, for example. Hence, action against the jet of ink has been taken by employing a comb-like ink guidance member called a collector or by employing a structure for buffering pressure inside the ink tank. However, these methods increase a number of parts, disadvantageously causing cost increase or complicated assembly process.

Patent literatures listed below disclose techniques of solving the aforementioned problem. According to these techniques, an ink tank is made of a flexible material and a valve (or a spring) is installed on a writing tip portion, thereby making the ink tank shrink in response to writing.

Patent Document 1: JP 2000-177290 A.

Patent Document 2: JP S29-13711 Y.

Patent Document 3: JP S35-25220 Y.

SUMMARY OF INVENTION

Of the aforementioned conventional techniques, the invention described in Patent Document 1 discloses a writing implement using a laminated film as an ink tank. In this writing implement, however, a writing tip where ink is discharged functions as a valve mechanism. Hence, if an impact is caused by being dropped or writing proceeds particularly with the tip facing upward, air might be mixed into the ink tank.

In Patent Document 2, a joint between an inner pouch and a mouth piece is tied with a strip of string. Hence, creases occur at a junction of a film and its vicinity so that sufficient attachment strength cannot be assured. As a result, air bubbles may be generated inside an ink tank, causing adverse effect on writing performance to lead to faint writing, for example.

In Patent Document 3, a neck portion and an inner pouch are joined with a metal ring. Meanwhile, a great deal of power is required for press fitting into a member at a pen tip, making it difficult to realize easy assembly. Additionally, if the pen according to the document is placed in an environment subjected to temperature change such as that from high temperature to low temperature while being used as a writing implement, the low expansion coefficient of the metal ring might reduce joint strength.

In any case, it has been difficult to ensure sealing performance and strength at a junction between a film part and a writing part such as a pen tip.

In view of the aforementioned problems, a subject of the present invention is to provide a writing implement of a simple structure that prevents flow of air into an ink tank and prevents writing failure while allowing for productivity.

(1) First Invention

In order to solve the aforementioned problem, a first invention of the present invention is a writing implement refill comprising:

a flexible ink tank storing ink, a writing tip connected to a tip of the ink tank, an outer circumferential surface of a rear end of the writing tip being covered with an inner circumferential surface of the tip of the ink tank, and a covering member covering over an area where the tip of the ink tank covers the outer circumferential surface of the rear end of the writing tip.

In the present invention, a "tip" means a side where the writing tip of the writing implement refill exists, and a "rear end" means a side opposite the tip.

"Flexibility" means formation deformable easily in response to pressing force of a hand. More specifically, using a thin layer (film) made of, for example, synthetic resin to form the ink tank makes the ink tank flexible.

Regarding the "writing tip," if the writing implement refill is for a ballpoint pen, for example, a ballpoint pen tip is attached as the writing tip to the tip of the ink tank, for example. If the writing implement refill is for a felt-tip pen, a core made of felt or synthetic fiber is attached as the writing tip to the tip of the ink tank, for example.

In particular, if the writing tip is for a ballpoint pen, force to press a ball where ink is discharged is applied by a spring and the like in a direction toward the tip in the absence of a writing load. This prevents leakage of the ink from a pen tip even if pressure is applied to the film.

(2) Second Invention

In order to solve the aforementioned problem, a second invention of the present invention is a writing implement refill comprising:

a flexible ink tank storing ink;

a joint connected to a tip of the ink tank; an outer circumferential surface of a rear end of the joint being covered with an inner circumferential surface of the tip of the ink tank; and a writing tip connected to a tip of the joint; and covering member covering over an area where the tip of the ink tank covers the outer circumferential surface of the rear end of the joint.

The "joint" is a member formed so as to distribute ink stored in the ink tank to the writing tip. Specifically, in the present invention, the writing tip is fitted to the ink tank via the joint.

(3) Third Invention

In order to solve the aforementioned problem, in addition to the aforementioned characteristics of the second invention, a third invention of the present invention is characterized in that the covering member is formed into a ring shape, the area where the tip of the ink tank covers the outer circumferential surface of the rear end of the joint is covered with an inner circumferential surface of the covering member, and a protruding part is formed on the outer circumferential surface of the rear end of the joint and/or the inner circumferential surface of the covering member, the protruding part protruding toward the other circumferential surface.

As described above, the outer circumferential surface of the rear end of the joint and the inner circumferential surface of the covering member face each other through a tip portion of the ink tank. The "protruding part" is provided on at least one of these circumferential surfaces. Thus, the protruding part protruding from one of the circumferential surfaces presses the other circumferential surface. As a result, the joint and the covering member fit with each other with greater force. The protruding part may certainly be provided on each of these circumferential surfaces.

(4) Fourth Invention

In order to solve the aforementioned problem, in addition to the aforementioned characteristics of the third invention, a fourth invention of the present invention is characterized in that the protruding part is formed on each of the outer circumferential surface of the rear end of the joint and the inner circumferential surface of the covering member, one of the protruding parts functioning to retain the other protruding part.

Specifically, in addition to the third invention, the protruding part protrudes from each of the circumferential surfaces toward the other circumferential surface. Thus, the joint and the covering member fit with each other with greater force. Additionally, the tip portion of the ink tank is held more reliably between the joint and the covering member while being curved into an S shape formed by these protrusions.

If the protruding parts on both of the circumferential surfaces are formed as elongated protrusions extending along the outer circumferential surface, one of the protruding parts closer to a rear end also functions to retain a protruding part closer to the tip. If two protruding parts are formed on one of the circumferential surfaces so that one of the two locates in front of the other while one protruding part is formed on the other circumferential surface and between the former two protruding parts, the protruding parts on both the circumferential surfaces function to retain each other.

(5) Fifth Invention

In order to solve the aforementioned problem, in addition to the aforementioned characteristics of the first, second or third invention, a fifth invention of the present invention is characterized in that the writing implement refill is entirely made of a plastic material except for ink stored in the writing implement refill.

The plastic material mentioned herein may be a nonmetallic material that can be incinerated relatively easily represented by a synthetic resin material such as PET, PBT, PE, EVOH, ABS, polypropylene, polycarbonate, polyacetal, or a cyclic olefin resin. The plastic material mentioned herein may also be one formed by adding to such a synthetic resin material a metallic material of a small quantity that generally allows the plastic material to be disposed of as plastic rubbish. As an example, the plastic material mentioned herein may be a material having a surface decorated with metal foil or the like, or a material to which metal powder is mixed.

Using such a plastic material for forming the writing implement refill allows disposal of the used writing implement refill as plastic rubbish without the need of separately disposing metallic materials, such as a tip.

(6) Sixth Invention

In order to solve the aforementioned problem, a sixth invention of the present invention relates to a writing implement comprising the writing implement refill according to the first, second, third or fourth invention, and a shaft tube housing the writing implement refill.

The "writing implement" is a ballpoint pen or a felt-tip pen, for example.

The present invention of the aforementioned structure achieves the following effects.

According to the structure of the first or second invention, the ink tank is composed of the flexible film. Force generated by atmospheric pressure and acting to compress the ink tank is applied to the ink tank swelling with ink filled therein. If the ink flows out of the ink tank, the ink tank contracts by the amount of ink having flown out of the ink tank. Specifically, force acting to push the ink out of the ink tank is applied to the ink in the ink tank. This makes it possible to use up the ink while preventing flow of air into the ink tank while preventing writing failure. Flow of air into the ink tank is also prevented during writing with the writing tip facing upward. Further, since virtually all the air can be eliminated from the ink tank, a structure for buffering pressure inside the ink tank becomes unnecessary.

According to the structure of the second invention, the area where the tip of the ink tank covers the outer circumferential surface of the rear end of the joint is covered with the inner circumferential surface of the covering member. This covering member functions to prevent leakage of ink due to the tip of the ink tank coming off from the outer circumferential surface of the rear end of the joint.

Attaching the covering member made of resin realizes a simple structure and favorable assembling performance while providing a strength required for a writing implement.

According to the structure of the third invention, protrusions are formed on junction surfaces of the joint and the covering member with the ink tank. This reduces a gap around the ink tank to enhance sealing performance and fixation strength without entailing high cost and without involving troublesome work during manufacture.

According to the structure of the fourth invention, protruding parts are formed both on the joint and the ink tank and the joint and the ink tank are fitted. Further, the joint and the covering member are fitted such that the film is formed into an S shape in cross section. As a result, sealing performance and fixation strength are enhanced further.

According to the structure of the fifth invention, substantially all of the components are made of a plastic material. Thus, disposal of the writing implement refill does not require separately disposing, for example, a metallic component, allowing reduction of cost for disposal.

DESCRIPTION OF REFERENCE NUMERALS

Figure 1:
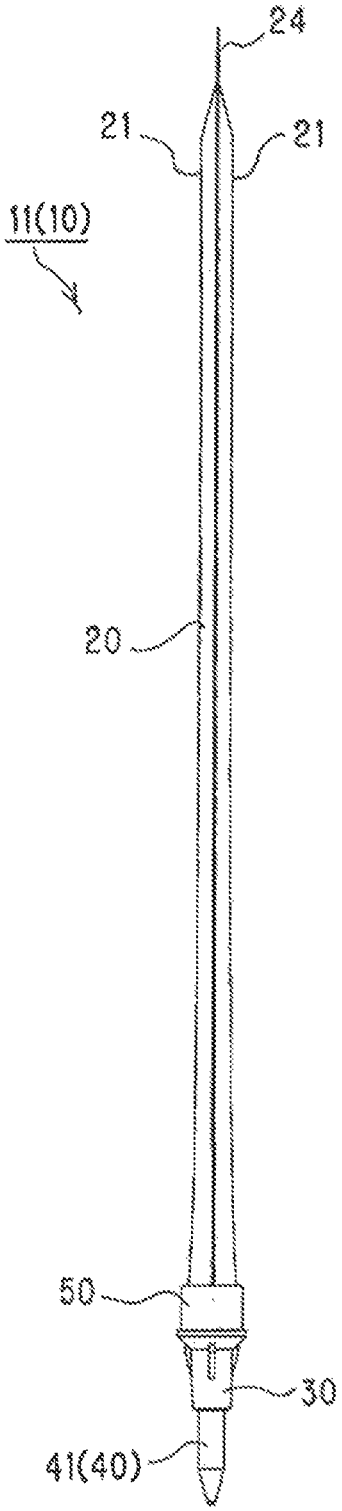
FIGS. 1A and 1B are a side view and a front view, respectively, showing a ballpoint pen refill of a first embodiment of the present invention.
Figure 1:
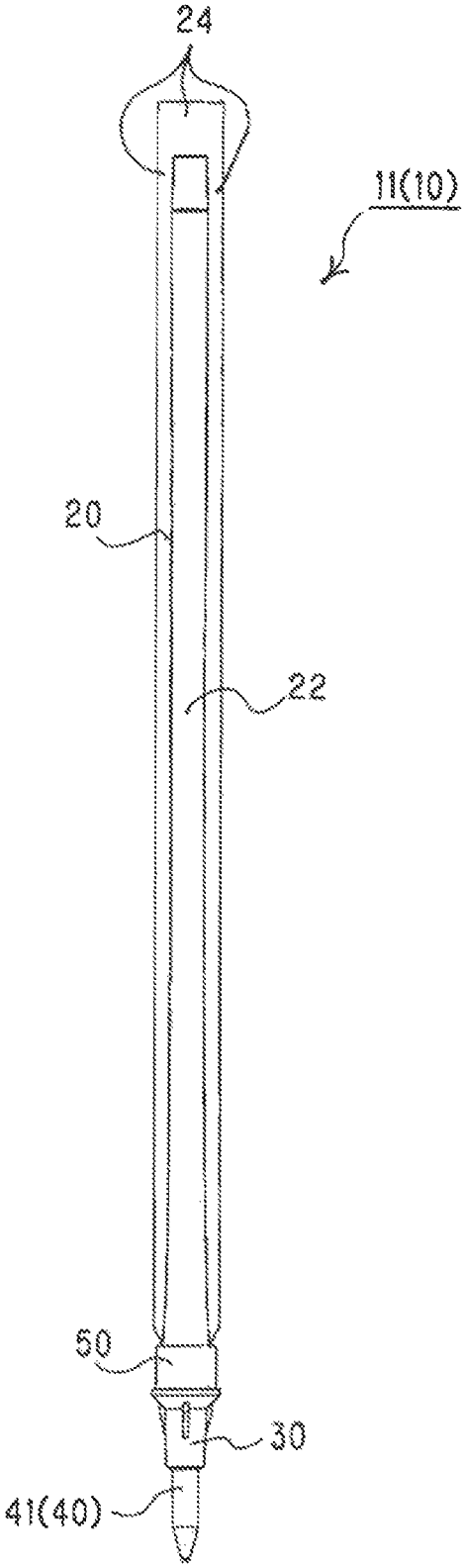

10 Writing Implement Refill
11 Ballpoint pen refill
20 Ink tank

21 Film
22 Ink storage
23 Tank coupling part
24 Welded part
25 Tank port
30 Joint
31 Joint coupling part
32 Flange part
33 Diameter shrinking part
34 Socket part
35 Ink distribution path
36 Protruding part
40 Writing tip
41 Ballpoint pen tip
42 Holder
43 Writing ball
44 Spring
45 Rear portion
50 Covering member
51 Protruding part
60 Writing implement
61 Ballpoint pen
62 Shaft tube
63 Air hole
64 Tube port
65 Mouthpiece
66 Tip hole

DESCRIPTION OF EMBODIMENTS

Embodiments of the present invention are described below by referring to the drawings.

(1) First Embodiment

As shown in FIG. 1A, a ballpoint pen refill 11 as a writing implement refill 10 of a first embodiment of the present invention includes an ink tank 20 composed of films 21 storing ink, a joint 30 made of synthetic resin connected to a tip of the ink tank 20, and a ballpoint pen tip 41 connected to a tip of the joint 30.

The ink tank 20 is formed by welding the two polyethylene films 21 into a pouch. Specifically, the two polyethylene films 21 are welded at their rear ends and their peripheries at both side ends to form the ink tank 20 such that the resultant ink tank 20 has an opening at its tip.

As shown in FIG. 1B, the ink tank 20 includes an ink storage 22 storing ink therein. A welded part 24 where the peripheries of the two films 21 are welded is formed at each of a rear end and both side ends of the ink tank 20. Specifically, internal space surrounded by parts of the two films 21, other than the welded part 24 where the films 21 are welded, functions as the ink storage 22.

Figure 3:
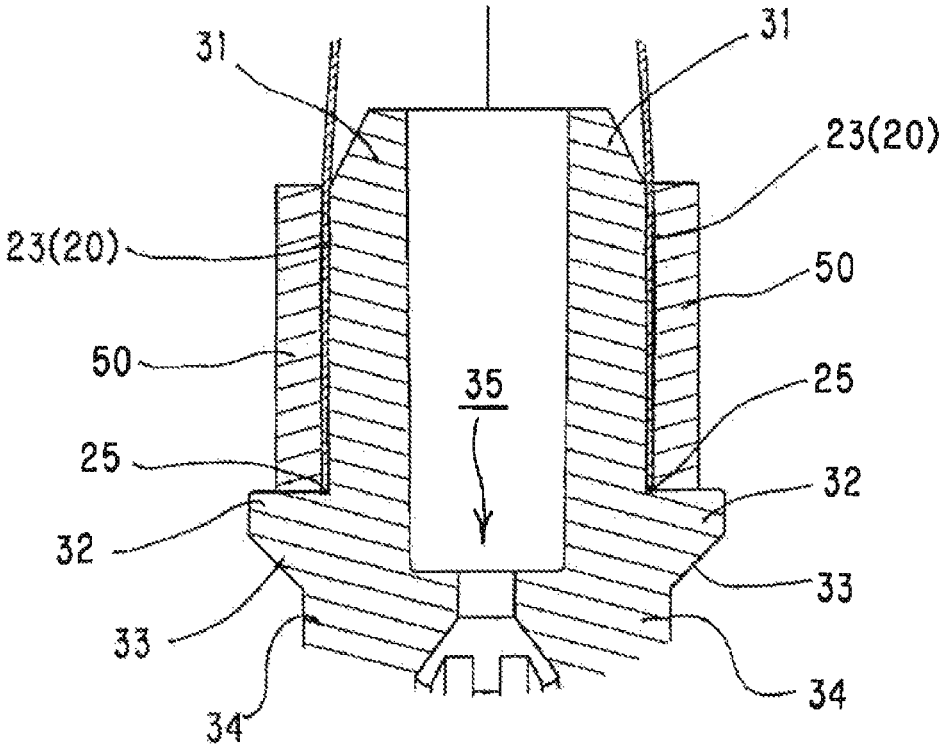
FIG. 3 shows an area I of FIG. 2 in an enlarged manner.

As shown in FIG. 3, a joint coupling part 31 of a cylindrical shape is formed at a rear end of the joint 30. On the other hand, a tank port 25 that can receive the joint coupling part 21 therein opens at the tip of the ink tank 20. A tip portion of the ink tank 20 functions as a tank coupling part 23 that covers the outer circumferential surface of the joint coupling part 31.

Figure 2:
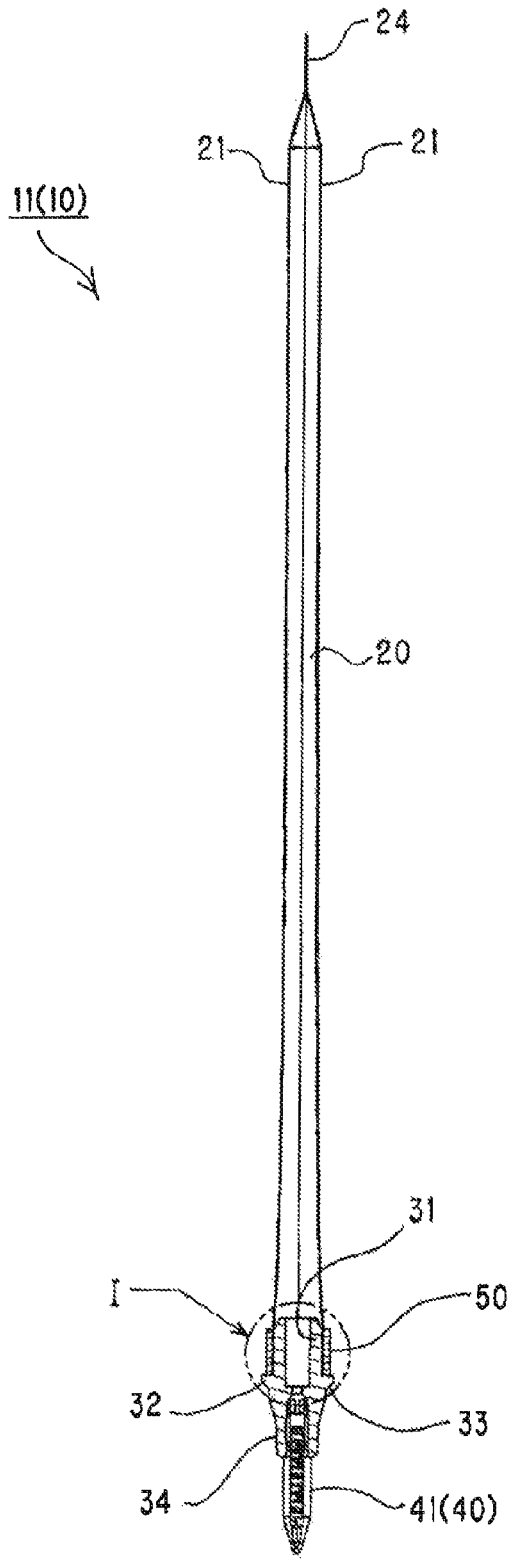
FIG. 2 is a side sectional view of the ballpoint pen refill of the first embodiment.

As shown in FIGS. 2 and 3, the joint 30 has a flange part 32 of a shape that increases stepwise in outer diameter from a tip of the joint coupling part 31, a diameter shrinking part 33 of a shape that shrinks in outer diameter in a tapered form toward a tip thereof from a tip of the flange part 32, and a socket part 34 of a cylindrical shape having the same outer diameter as a tip of the diameter shrinking part 33. As shown in FIG. 3, an ink distribution path 35 is formed in the joint 30 that passes through the inside of the joint 30 from the flange part 32 toward the diameter shrinking part 33. The ink distribution path 35 is provided to distribute ink having flowed into the joint coupling part 31 from the ink tank 20 to the socket part 34. As shown in FIG. 2, a ballpoint pen tip 41 as a writing tip 40 is press fitted in a tip of the socket part 34.

As shown in FIG. 3, the outer circumferential surface of the rear end of the joint 30 is covered with the inner circumferential surface of the tip of the ink tank 20. More specifically, the outer circumferential surface of the joint coupling part 31 is covered with the inner circumferential surface of the tank coupling part 23.

Specifically, the joint coupling part 31 is inserted in the tank port 25 of the tank coupling part 23 to form abutting contact between a rear end of the flange part 32 and a tip of the tank coupling part 23 while forming contact between the outer circumferential surface of the joint coupling part 31 and the inner circumferential surface of the tank coupling part 23.

An area where the tip of the ink tank 20 covers the outer circumferential surface of the rear end of the joint 30 (specifically, an area where the tank coupling part 23 covers the outer circumferential surface of the joint coupling part 31) is further covered with a covering member 50 from outside.

The covering member 50 has a ring shape and made of a polypropylene resin. The covering member 50 is formed such that the inner diameter thereof is substantially the same as the outer diameter of the joint coupling part 31.

While the tank coupling part 23 covers the outer circumferential surface of the joint coupling part 31, the covering member 50 is fitted to the outer circumferential surface of the tank coupling part 23. This places the tank coupling part 23 between the inner circumferential surface of the covering member 50 and the outer circumferential surface of the joint coupling part 31, thereby covering the outer circumferential surface of the tank coupling part 23 with the inner circumferential surface of the covering member 50.

Figure 4:
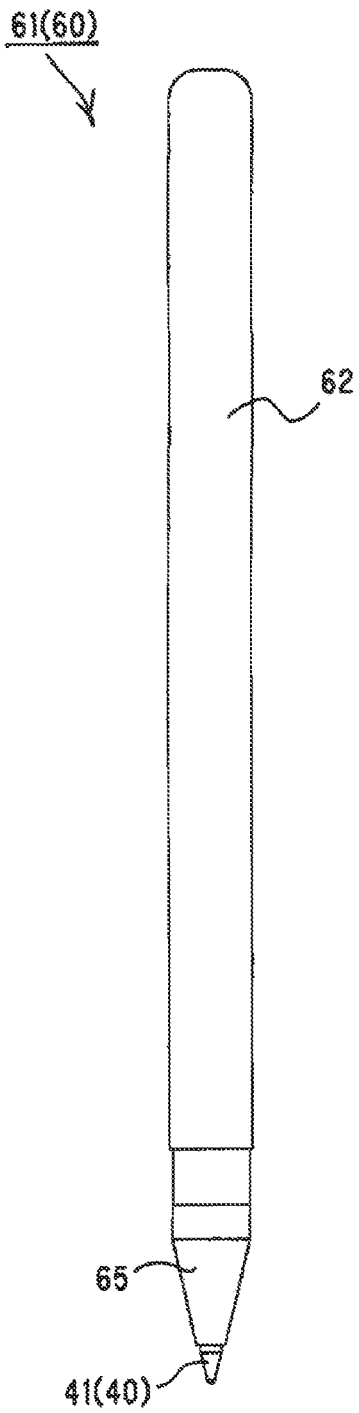
FIGS. 4A and 4B are a front view and a longitudinal sectional view, respectively, showing a ballpoint pen using the ballpoint pen refill of the first embodiment of the present invention.
Figure 4:
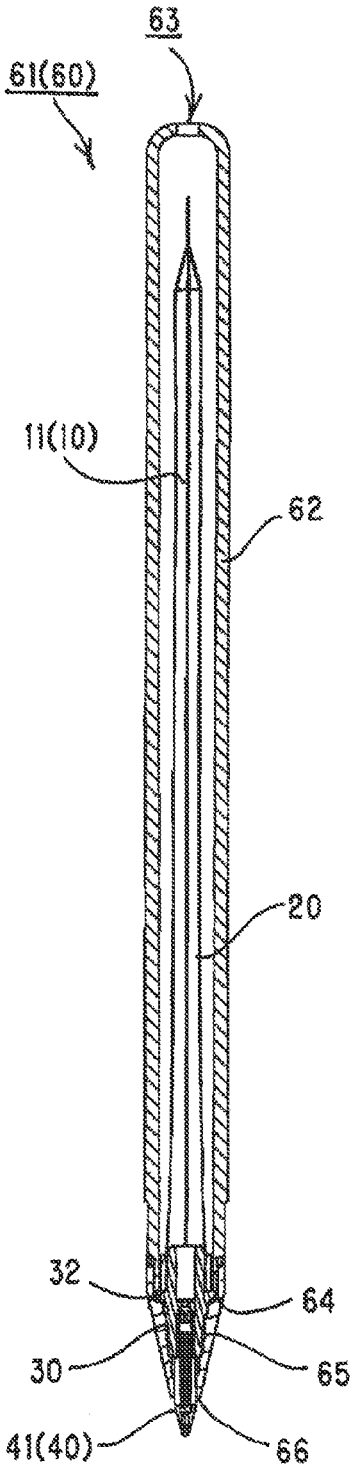

The ballpoint pen refill 11 is fitted to a shaft tube 62 made of synthetic resin, thereby forming a ballpoint pen 61 as a writing implement 60 shown in FIG. 4A. As shown in FIG. 4B, the shaft tube 62 is a hollow columnar shape having a rear end provided with an air hole 63. A tube port 64 is formed at a tip of the shaft tube 62. A rear end of the ink tank 20 is inserted through the tube port 64 into the shaft tube 62 to make the flange part 32 of the joint 30 abut on the tube port 64 at a tip edge of the shaft tube 62. A mouthpiece 65 is screwed to the tip of the shaft tube 62. The mouthpiece 65 has an outer circumference shrinking in diameter in a tapered form toward a tip thereof. The mouthpiece 65 is formed into a circle in cross section having an inner diameter reduced stepwise from its rear end toward the tip thereof. A tip hole 66 that lets the ballpoint pen tip 41 pass therethrough is formed at the tip of the mouthpiece 65. While the mouthpiece 65 being screwed, the ballpoint pen tip 41 is caused to pass through the tip hole 66 from the rear end of the mouthpiece 65. When the tip of the socket 34 abuts on the inner circumferential surface of the mouthpiece 65, the ballpoint pen tip 41 is secured while a tip portion of the ballpoint pen tip 41 is exposed from the tip hole 66. When the mouthpiece 65 is screwed to the shaft tube 62, the joint 30 is held between the inner circumferential surface of the mouthpiece 65 and the tip edge of the shaft tube 62, thereby fitting the ballpoint pen refill 11 to the shaft tube 62.

This embodiment of the aforementioned structure achieves the following effects.

The ink tank 20 of this embodiment is composed of the flexible films 21. Force generated by atmospheric pressure and acting to compress the ink tank 20 is applied to the ink tank 20 swelling with ink filled in the ink tank 20. If the ink flows out of the ink storage 22, the ink tank 20 contracts by the ink having flown out of the ink tank 20. Specifically, force acting to push the ink out of the ink storage 22 is applied to the ink in the ink tank 20. This makes it possible to use up the ink while preventing flow of air into the ink tank 20 while preventing writing failure. Flow of air into the ink tank 20 is also prevented during writing with the ballpoint pen tip 41 facing upward. Further, since almost all the air can be eliminated from the ink tank 20, a structure for buffering pressure inside the ink tank 20 becomes unnecessary.

In the first embodiment, the area where the tank coupling part 23 covers the outer circumferential surface of the joint coupling part 31 is covered with the inner circumferential surface of the covering member 50. The covering member 50 functions to prevent leakage of the ink due to the tank coupling part 23 coming off from the outer circumferential surface of the joint coupling part 31.

In this embodiment, the ink tank 20 of an unused ballpoint pen refill 11 swells with ink. Further, force of the films 21 forming the ink tank 20 trying to contract the ink tank 20 is applied as well as atmospheric pressure to the ink tank 20. As a result, the unused ballpoint pen refill 11 receives greater force acting to push the ink out of the ink storage 22 than the ballpoint pen refill 11 having been used to some extent. Thus, the amount of ink which flows out of the ink storage 22 of the ballpoint pen refill 11 at the start of use is greater than that of the ballpoint pen refill 11 having been used to some extent.

By the way, as to a conventional ballpoint pen refill, a ballpoint pen tip having been used to some extent achieves more excellent feeling of writing than an unused ballpoint pen tip. In contrast, the ballpoint pen refill 11 of this embodiment allows, as described above, greater amount of ink to flow out of the ink storage 22 at the start of use. Thus, the ballpoint pen tip 41 at the start of use can still achieve excellent feeling of writing.

In this embodiment, the rear end of the ink tank 20 is thinner than the tip thereof. Further, the welded part 24 is formed at opposite side ends of the ink tank 20, thereby making it possible to use up the ink while preventing buckling of the ink tank 20.

If the joint 30 connected to the tip of the ink tank 20 has a linear expansion coefficient which is the same as, or falls within a range of ±50% of, that of the covering member 50, change in temperature environment does not change attachment strength. This can ensure long-term storage.

(2) Second Embodiment

Figure 5:
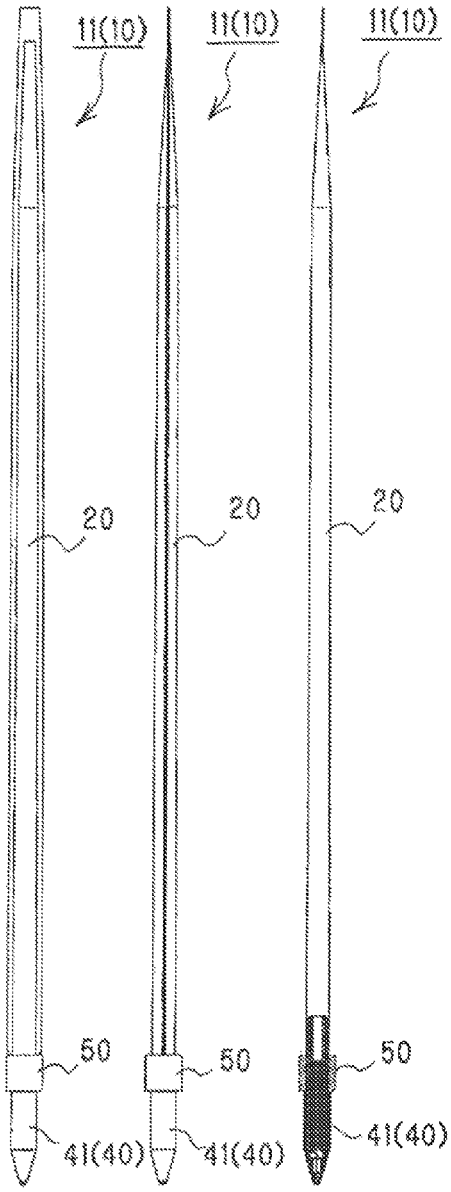
FIGS. 5A, 5B, and 5C are a front view, a side view, and a side sectional view, respectively, of a ballpoint pen refill of a second embodiment of the present invention.
FIG. 5D shows principal part of FIG. 5C in an enlarged manner.
Figure 5:
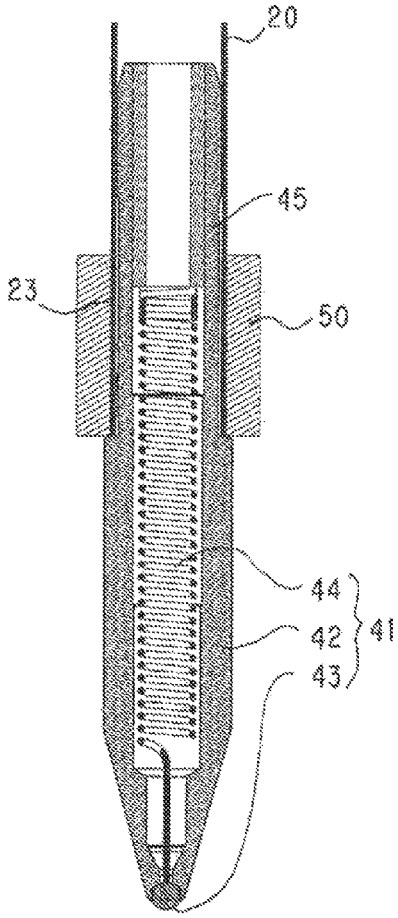

As shown in FIG. 5, a second embodiment of the present invention does not use the joint 30 of the first embodiment. Specifically, the ballpoint pen tip 41 is fitted directly, without the intervention of the joint 30, to the ink tank 20 (see FIGS. 5A to 5C) of the same structure as that of the first embodiment.

As shown in FIG. 5D, the ballpoint pen tip 41 used in this embodiment includes a holder 42 formed by cutting a cylindrical member made of stainless steel and a writing ball 43 made of cemented carbide held at a tip of the holder 42. The holder 42 has a spring 44 contained therein so as to bias the writing ball 43 toward the tip.

A rear portion 45 of the holder 42 is cut so as to shrink in diameter. The rear portion 45 is directly covered with the tank coupling part 23 corresponding to a tip portion of the ink tank 20, and is further covered with the covering member 50 from outside the tank coupling part 23.

(3) Third Embodiment

Figure 6:
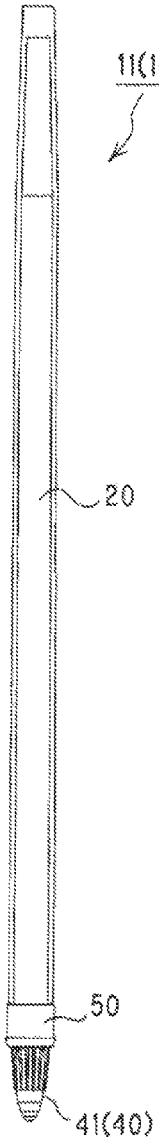
FIGS. 6A, 6B, and 6C are a front view, a side view, and a side sectional view, respectively, of a ballpoint pen refill of a third embodiment of the present invention.
FIG. 6D shows principal part of FIG. 6C in an enlarged manner.
Figure 6:
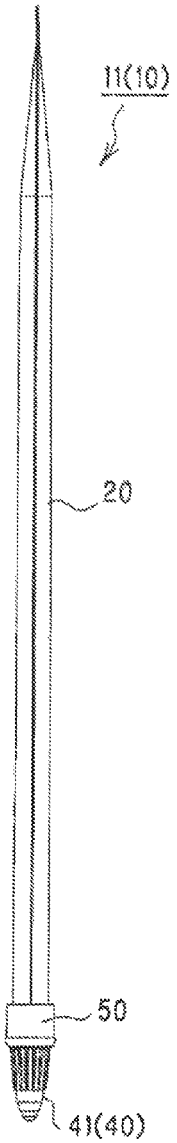
Figure 6:
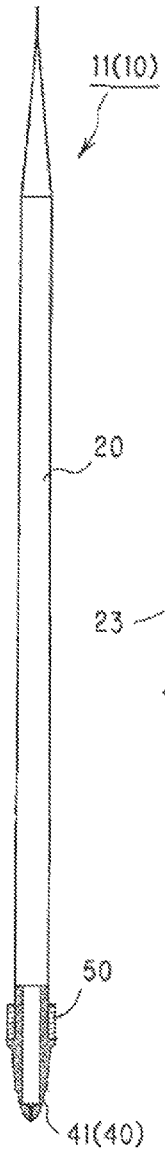
Figure 6:
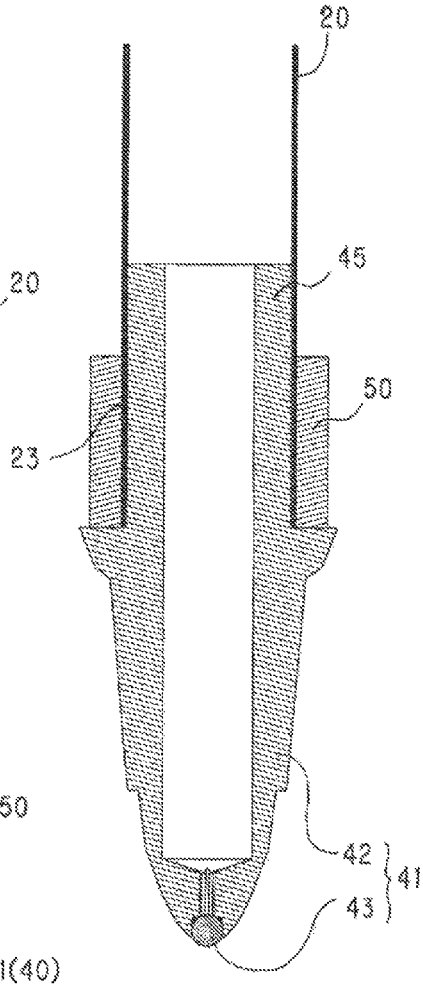

As shown in FIG. 6, similarly to the second embodiment, the ballpoint pen tip 41 of a third embodiment is fitted directly, without the intervention of the joint 30, to the ink tank 20 (see FIGS. 6A to 6C) of the same structure as that of the first embodiment. In this embodiment, the ballpoint pen tip 41 including the writing ball 43 is entirely made of plastic.

Specifically, the holder 42 of the ballpoint pen tip 41 is formed by injection molding of a polyacetal material and then by cutting process. The writing ball 43 is made of a mixture of a nylon resin and tungsten powder. The writing ball 43 is pressed to fit through a tip of the holder 42 by elastic deformation. Alternatively, the writing ball 43 is inserted into the tip of the holder 42 and then the circumference of the tip is deformed thermally, thereby holding the writing ball 43 at the tip of the holder 42.

As in the second embodiment, the rear portion 45 of the holder 42 is formed so as to shrink in diameter. The rear portion 45 is directly covered with the tank coupling part 23 corresponding to a tip portion of the ink tank 20, and is further covered with the covering member 50 from outside the tank coupling part 23.

(4) Fourth Embodiment

Figure 7:
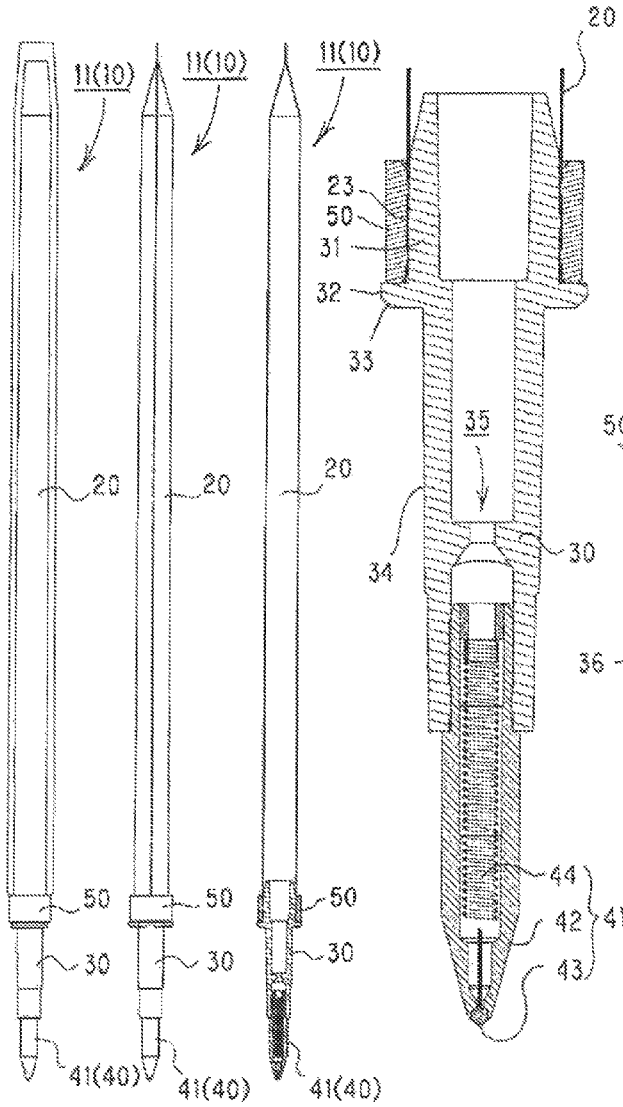
FIGS. 7A, 7B, and 7C are a front view, a side view, and a side sectional view, respectively, of a ballpoint pen refill of a fourth embodiment of the present invention.
FIG. 7D shows principal part of FIG. 7C in an enlarged manner.
FIG. 7E shows principal part of FIG. 7D in an enlarged manner.
Figure 7:
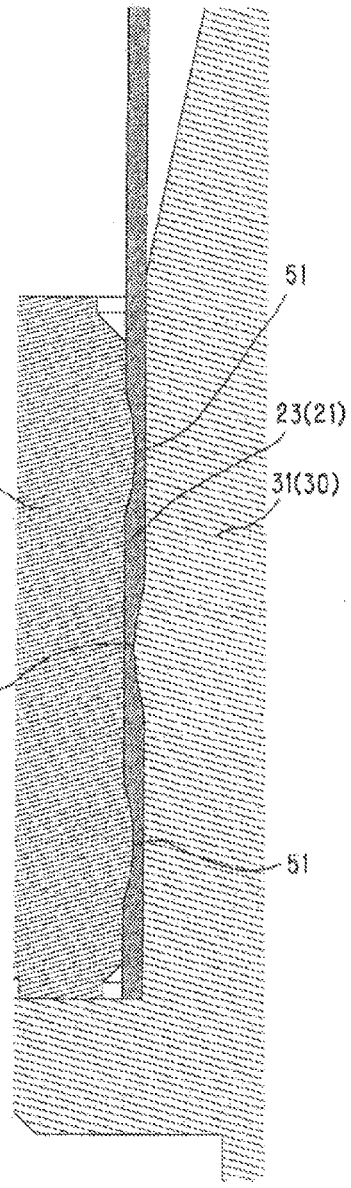

In a fourth embodiment, as in the first embodiment, the ballpoint pen tip 41 is fitted through the joint 30 to the ink tank 20 (see FIGS. 7A to 7C) of the same structure as that of the first embodiment, as shown in FIG. 7. As in the first embodiment, the joint coupling part 31 formed at a rear end of the joint 30 is covered with the tank coupling part 23 corresponding to a tip portion of the ink tank 20, and the outer circumference of the tank coupling part 23 is further covered with the covering member 50 (see FIG. 7D).

In this embodiment, two elongated protrusions are formed as protruding parts 51 along the inner circumferential surface of the covering member 50, as shown in FIG. 7E. Further, one elongated protrusion is formed as a protruding part 36 along the outer circumferential surface of the joint coupling part 31 and in an intermediate position between the two protruding parts 51. The protruding parts 51, 36 and 51 bend the films 21 forming the ink tank 20 into an S shape while the covering member 50 fits the joint coupling part 31, thereby enhancing fitting force. Each of the protruding parts 51, 36 and 51 protrudes from a circumferential surface on which it is formed to press the other circumferential surface. As a result, the joint and the covering member fit each other with greater force. One of the protruding parts 51 of the covering member 50 closer to a rear end functions to retain the protruding part 36 of the joint coupling part 31. Likewise, the protruding part 36 of the joint coupling part 31 functions to retain one of the protruding parts 51 of the covering member 50 closer to a tip.

EXAMPLES

Examples of the present invention are described below by being compared with Comparative Examples.

In each of Examples 1 to 3 of the present invention, an ink tank composed of films such as that described in the first embodiment was used. In each of Comparative Examples 1 to 3 to be compared with Examples 1 to 3, a conventionally used ink tank composed of a polypropylene tube was used.

The ink tank of each of Example 1 and Comparative Example 1 was filled with commercially available oil-based ink of a viscosity of 15,000 mPa·sec. The ink tank of each of Example 2 and Comparative Example 2 was filled with commercially available aqueous gel-based ink of a viscosity of 300 mPa·sec. The ink tank of each of Example 3 and Comparative Example 3 was filled with commercially available aqueous gel-based ink of a viscosity of 70 mPa·sec.

A ballpoint pen tip such as that described in the aforementioned embodiments was fitted to the ink tank of each of Examples and Comparative Examples to form a refill. A ball diameter was 0.7 mm in Example 1 and Comparative Example 1, and 0.5 mm in Example 2, Comparative Example 2, Example 3, and Comparative Example 3.

The ink tank of each of Examples and Comparative Examples thereby formed was fitted to a shaft tube such as that described in the aforementioned embodiments, and was devoted to a writing test. In the writing test, in each of Examples and Comparative Examples, while being placed on a writing tester in compliance with JIS standards, after a 50-m line being drawn first, the amount of consumed ink while a 100-m line was drawn was measured.

Table 1 given below shows the properties of the ink tank and the refill of each of Examples and Comparative Examples and a result of the writing test obtained in each of Examples and Comparative Examples.

TABLE 1

| Examples/ Comparative Examples | Material of Ink Tank | Ink Type | Ink Viscosity (mPa · sec) | Ball Diameter (mm) | Ink Consumption (mg) |
|---|---|---|---|---|---|
| Example 1 | film | oil-based | 15,000 | 0.7 | 20 |
| Comp. Ex. 1 | tube | oil-based | 15,000 | 0.7 | 21 |
| Example 2 | film | aqueous gel-based | 300 | 0.5 | 107 |
| Comp. Ex. 2 | tube | aqueous gel-based | 300 | 0.5 | 111 |
| Example 3 | film | aqueous gel-based | 70 | 0.5 | 104 |
| Comp. Ex. 3 | tube | aqueous gel-based | 70 | 0.5 | 100 |

As shown in Table 1, the amount of ink consumption in the ink tank of Example 1 was 20 mg whereas that in the ink tank of Comparative Example 1 was 21 mg, showing that these are substantially the same.

The amount of ink consumption in the ink tank of Example 2 was 107 mg whereas that in the ink tank of Comparative Example 2 was 111 mg, showing that these are also substantially the same.

The amount of ink consumption in the ink tank of Example 3 was 104 mg whereas that in the ink tank of Comparative Example 3 was 100 mg, showing that these are still substantially the same.

As described above, where Examples and Comparative Examples differ only in a material for the ink tanks while other conditions being the same, the ink consumption in the ink tank of each Examples composed of films is as much as that in the ink tank of each Comparative Examples composed of a polypropylene tube. Specifically, the aforementioned results show that the ink tank composed of films is not inferior in terms of the ink consumption to a conventionally used ink tank composed of a polypropylene tube, so that it can provide almost the same feeling of writing.

INDUSTRIAL APPLICABILITY

The present invention is suitably applied for use in writing implements such as ballpoint pens and felt-tip pens, and writing implement refills for such writing implements.

The invention claimed is:

1. A writing implement refill comprising:

a flexible ink tank storing ink, the flexible ink tank including two flexible films whose peripheries are welded together at their rear ends and at opposite side ends, and having an opening at a tip of the flexible ink tank;

a ballpoint pen tip connected to the tip of the flexible ink tank, the ballpoint pen tip including a holder and a writing ball held at a tip of the holder, wherein an outer circumferential surface of a rear end of the holder is covered with an inner circumferential surface of the tip of the flexible ink tank, and a covering member covering over an area where the tip of the flexible ink tank covers the outer circumferential surface of the rear end of the holder.

2. A writing implement refill comprising:

a flexible ink tank storing ink, the flexible ink tank including two flexible films whose peripheries are welded together at their rear ends and at opposite side ends, and having an opening at a tip of the flexible ink tank;

a joint connected to the tip of the flexible ink tank; an outer circumferential surface of a rear end of the joint being covered with an inner circumferential surface of the tip of the flexible ink tank; and a ballpoint pen tip connected to a tip of the joint, the ballpoint pen tip including a holder and a writing ball held at a tip of the holder; and covering member covering over an area where the tip of the flexible ink tank covers the outer circumferential surface of the rear end of the joint.

3. The writing implement refill according to claim 2, wherein:

the covering member is formed into a ring shape, the area where the tip of the ink tank covers the outer circumferential surface of the rear end of the joint is covered with an inner circumferential surface of the covering member, and a protruding part is formed on the outer circumferential surface of the rear end of the joint and/or the inner circumferential surface of the covering member, the protruding part protruding toward the other circumferential surface.

4. The writing implement refill according to claim 3, wherein the protruding part is formed on each of the outer circumferential surface of the rear end of the joint and the inner circumferential surface of the covering member, one of the protruding parts functioning to retain the other protruding part.

5. The writing implement refill according claim 1, 2, 3 or 4, wherein the writing implement refill is entirely made of a plastic material except for ink stored in the writing implement refill.

6. A writing implement comprising the writing implement refill as recited in claim 1, 2, 3 or 4 and a shaft tube housing the writing implement refill.

* * * * *